US005413038A

United States Patent [19]

Josl-Enneking et al.

[11] Patent Number: 5,413,038

[45] Date of Patent: May 9, 1995

[54] PRINTING MACHINE

[75] Inventors: Werner Josl-Enneking, Lotte; Guenter Rogge, Lienen, both of Germany

[73] Assignee: Windmöller & Hölscher, Lengerich/Westf., Germany

[21] Appl. No.: 208,522

[22] Filed: Mar. 11, 1994

[30] Foreign Application Priority Data

Mar. 17, 1993 [DE] Germany ..... 43 08 492.3

[51] Int. Cl.[6] ..... B41F 5/18; B41F 5/24

[52] U.S. Cl. ..... 101/178; 101/247

[58] Field of Search ..... 101/178, 180, 181, 220, 101/182, 247, 352, 351, 248, 184, 185, 136, 138, 209

[56] References Cited

U.S. PATENT DOCUMENTS

| | | | |
|---|---|---|---|
| 1,519,544 | 12/1924 | McIndoe | 101/178 |
| 3,791,294 | 2/1974 | Skelding et al. | 101/352 X |
| 4,413,560 | 11/1983 | Rogge . | |
| 4,602,562 | 7/1986 | Ottenhues et al. . | |
| 4,896,600 | 1/1990 | Rogge et al. . | |
| 5,125,339 | 6/1992 | Rogge . | |

FOREIGN PATENT DOCUMENTS 742317 5/1943 Germany .

*Primary Examiner*—J. Reed Fisher

*Attorney, Agent, or Firm*—Keck, Mahin & Cate

[57] ABSTRACT

In a printing machine with an impression roll and several printing mechanisms, the bearings of the size cylinders and the inking device supports can be moved with the screen rolls on guides of the printing machine stand, approximately radially to the impression roll. The drive of the size cylinders and of the screen rolls is derived from a central drive. In order to create a simple continuously running drive for the inking device rolls, the screen rolls are actively connected via a freewheel to the central drive. For the screen rolls, which can be moved away from the size cylinders, a continuously running drive is provided which consists of a toothed belt, driven by a servomotor, which loops around all of the toothed drive wheels of the screen rolls. The strands of the toothed belt and the strands of the toothed belt enclosing the respectively radial external idle wheels in a loop-like manner, extend in parallel with each other. The inking roll supports can also be moved along their guides in parallel with the strands of the toothed belt which are in parallel with each other.

6 Claims, 2 Drawing Sheets

PRINTING MACHINE

FIELD OF THE INVENTION

The invention relates to a printing machine, preferably a flexographic printing machine having an impression roll and several printing mechanisms, wherein the position of the size cylinders and the inking device supports can be moved along with the screen roll, radially or nearly radially with respect to the impression roll, on guides of the printing support and wherein the drive of the size cylinders and of the screen rolls is derived from a central drive, preferably a central wheel.

BACKGROUND OF THE INVENTION

Flexographic printing machines of this type are known, for example, from German Patent [OLS] Nos. 2,941,521, 3,437,216, 3,742,129 and 4,001,735.

For printing machines and, in particular, also for flexographic printing machines, there exists the problem that when the machine is stopped, the ink dries on the inking rolls or on the screen rolls, so that upon restarting and further operation of the machine, difficulties occur. A known means to prevent this problem, is to move the inking rolls or screen rolls away from the size cylinders and to allow them to slowly continue to run, so that drying of the ink on the inking or screen rolls is prevented.

In the case of a known multicolor flexographic printing machine, known from German Patent No. 742,317, the impression rolls as well as the size cylinders assigned to each of the impression rolls and the screen rolls and dampening rolls of the inking devices are driven by a primary central wheel during the normal printing process, which directly meshes with the toothed wheels attached to the one shaft extension of the inking rolls, while the drives of the size cylinders and of the screen rolls and dampening rolls are derived from the toothed wheels wedged onto the other shaft extension. In order to assure continued operation during machine stoppages of the screen rolls and dampening rolls, which have been moved away from the size cylinders, a second central wheel, which can be driven by a servomotor, is provided which drives the meshing toothed drive wheels of the screen rolls and dampening rolls via toothed wheels which are placed in a freely rotatable manner on axle spindles of the impression rolls and the size cylinders, wherein a coupling device is provided which, during machine stoppages, switches the drive of the second central wheel to the servomotor.

However, due to its gear construction, this known continuous operation drive is very costly. Furthermore, even during a size cylinder change, toothed wheels must be exchanged in order to drive the inking device rolls.

For this reason, it is the purpose of the invention to create a simply constructed continuous operation drive for the inking device rolls and, in particular, the screen rolls of printing machines, especially flexographic printing machines.

SUMMARY OF THE INVENTION

In accordance with the invention, using a printing machine of the initially indicated type, this purpose is achieved in that the screen rolls are actively connected via a freewheel with the central drive or central wheel, in that for the screen rolls, which can be moved away from the size cylinders, a continuous operation drive is provided, which consists of a chain or a toothed wheel driven by a servomotor, both of which loop around all toothed wheels of the drive of the screen rolls by being guided via idle rolls, of which, three are respectively arranged in a fixed manner with the frame and one is arranged at the associated inking device or screen roll slide in such a way that the strands of the toothed belt which run onto and off the idle wheels, arranged radially outside the screen roll drive and the strands of the toothed wheel, framing the respective radial outer idle wheels in a loop-like manner, extend in parallel with each other and that the inking roll or the screen roll blocks can also be moved on their guides in parallel with the mutually parallel strands of the toothed belt.

Due to the parallel guidance of the strands of the toothed wheel and of the screen roll blocks, with the printing machine as claimed by the invention, it is possible to move the screen rolls in any desired direction toward the inking roll and away from it for the purpose of exchanging the size cylinders or during interruptions of the printing operation without a slackening of the toothed belt occurring therefrom with respect to the toothed wheels driving the screen rolls since, due to the parallel guidance of the strands of the toothed belt, a length compensation always takes place. Since, during normal printing operation, the drive of the toothed belt is coupled to the central drive or the central wheel via a freewheel, it is possible, in the case of machine shutdowns, to drive the toothed belts without problems by means of a continued operation motor, consisting of a servomotor. Advantageously, the servomotor also drives the toothed belt via a freewheel, so that during normal printing operations, the freewheel motor neither has to be decoupled nor carried along.

Advantageously, the screen rolls are driven by the central wheel via the toothed belt in that an intermediate toothed wheel meshes with the central wheel and a toothed wheel, arranged on the drive shaft for the toothed belt. In this way, the toothed belt, driving the screen rolls is driven by the central wheel without the toothed drive wheels of the size cylinders forming parts in the drive trains for the screen rolls.

Advantageously, the toothed wheel meshing with the intermediate toothed wheel is provided with a freewheel.

In accordance with a preferred embodiment, provisions are made wherein the drive shaft for the toothed belt has an additional toothed wheel, provided with a freewheel, which toothed wheel is actively connected with the servomotor. In this way, the two freewheels are arranged on a common shaft which carries the toothed drive wheel for the toothed belt.

The toothed wheels of the size cylinder may mesh directly with the toothed wheel, so that a simple exchange of the size cylinders is possible.

In the case of more recent inking devices and particularly with inking devices for flexographic printing machines, only one screen roll is provided which has a known ink chamber doctor blade into which the printing ink is directly introduced and from which same is again drawn off. Such known ink chamber doctor blades no longer require dampening rolls which are applied to the screen rolls.

BRIEF DESCRIPTION OF THE FIGURES

An example of the invention is explained below in greater detail by means of the drawings, wherein.

DETAILED DESCRIPTION OF THE PREFERRED EMBODIMENTS

Figure 1:
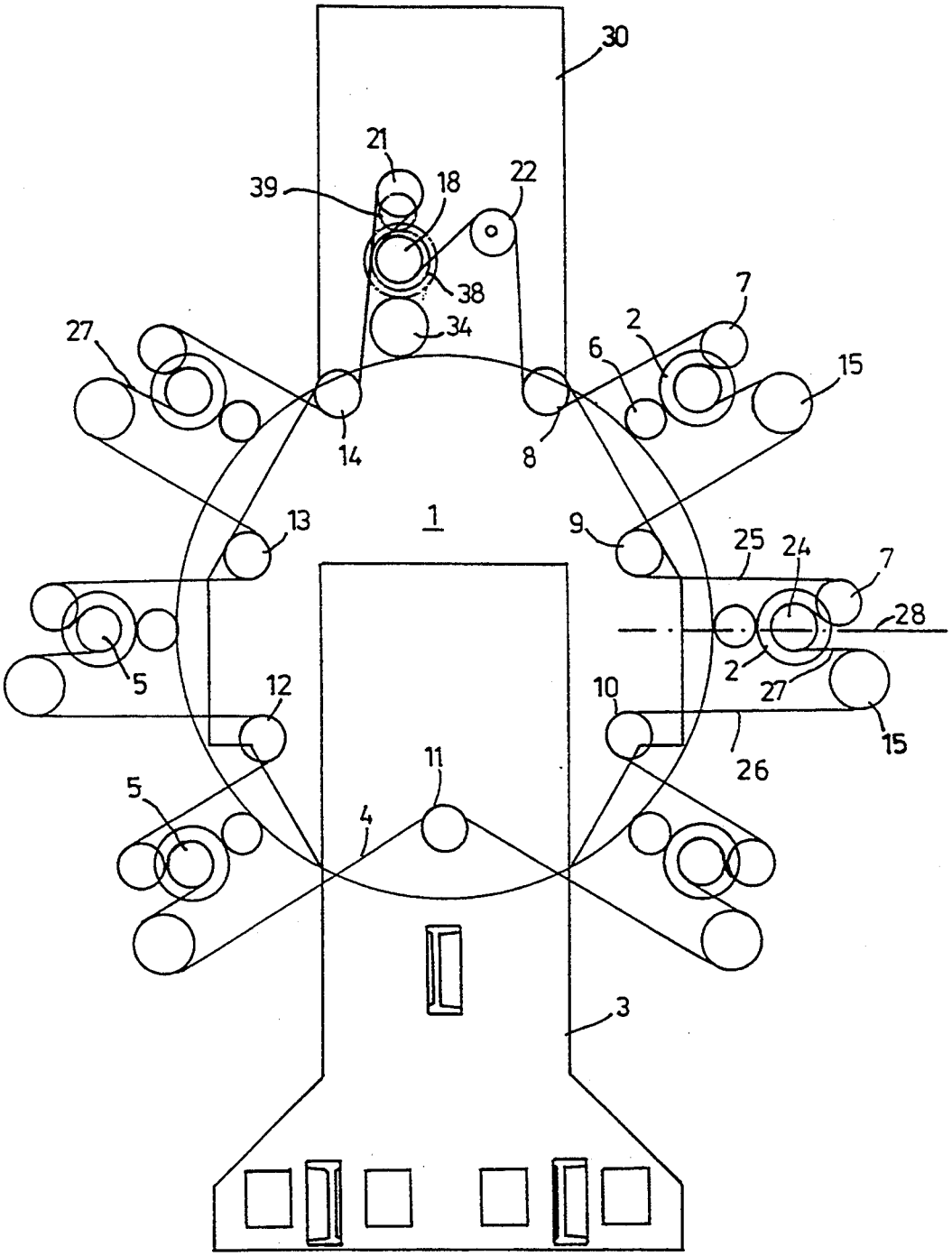
FIG. 1 shows a side view of a flexographic printing machine with six printing units in schematic representation and FIG. 2 shows a longitudinal section through the flexographic printing machine shown in FIG. 1.

The flexographic printing machine is basically of a known structural type as known, for example, from German Patent [OLS] Nos. 2,941,521, 3,437,216, 3,742,129 and 4,001,735, to which reference is made for the purpose of further explanation. The flexographic printing machine shown in the drawing has a frame in which, for all printing mechanisms, a common impression roll (1) is mounted. Furthermore, the printing machine frame is provided on both sides with brackets, which can be seen in German Patent [OLS] No. 2,941,521 and which are provided with guides for the slides carrying the size cylinder blocks, wherein these size cylinder slides, in turn, are provided with guides for the inking device blocks. While with the embodiment, described by means of the German Patent [OLS] 2,941,521, the inking devices consist of dampening rolls and inking rolls, the flexographic printing machine shown in the drawing has only one screen roll (2) which is provided in a known manner with an inking chamber doctor blade and therefore is not shown.

For the sake of better clarity, FIG. 1 shows only the frame (3) of the flexographic printing machine and above it, essentially only the guide of the toothed belt (4) which serves for the common drive of all drive wheels (5) of the screen roll (2).

In the frame (3), three printing mechanisms are arranged on the left side and on the right side, respectively. Each printing mechanism consists of a size or printing cylinder (6), mounted in a size cylinder block and movable on a size cylinder slide, with only the size cylinders (6) being indicated in the drawing. On the size cylinder slide, in straight-lined guides, the inking device slides are movably arranged on which, in appropriate screen roll blocks the screen rolls (2) are mounted.

Moreover, on each inking device slide, an idle wheel (7) for the toothed belt (4) is arranged in a freely rotatable manner. Thus, the idle wheel (7) is always movable together with the screen roll (2) without these changing their relative position to each other. In the frame, laterally with respect to the impression roll (1), inwardly offset idle wheels (8–14) for the toothed belt (4) are provided.

Extending radially outward from the screen rolls (2), inside the frame (3), freely rotatable idle wheels (15) for the toothed belt (4) are provided. The idle wheels (7, 15), assigned respectively to one printing mechanism, as well as the size cylinder (6) and the screen roll (2), respectively, have the same reference symbols.

The toothed belt (4) is an endless toothed belt which is driven by its drive wheel (18) by means of the servomotor (20), provided with a gear (19). In the area of the drive wheel (18), the toothed belt is guided across the idle wheels (21, 22), rigidly connected with the frame, so that it surrounds the drive wheel (18) in a loop-like manner.

Between the idle wheel (7), arranged on the inking device slide, and the idle wheel (15), rigidly mounted on the frame, the toothed belt (4) is guided in a loop-like manner via the toothed drive wheels (24) of the screen rolls (2) in the manner seen in FIG. 1.

The strands (25), passing respectively from the inner idle wheels (8–14) attached to the frame onto the idle wheels (7) and the strands (26) of the toothed belt (4), passing from the idle wheels (15) attached to the frame onto the inner idle wheels (10) attached to the frame, are in parallel with each other. Furthermore, the strands (27), extending from the toothed drive wheels (24) of the screen rolls (2) to the outer, idle wheels (15) attached to the frame are also in parallel with the strands (25, 26). Finally, the screen rolls (2) can also be moved on the screen roll slide on tracks (28), which are in parallel with the strands (25, 26, 27) of the drive belt (4). Through this type of reeving of the toothed belts (4), their length does not change during a movement of the screen rolls (2), because the changes in length of the strands (25, 27) always correspond to each other when the screen roll (2) is moved, so that a complete compensation of the changing lengths of the strands of the toothed belt (4) occurs.

In the example shown, the inner idle wheels (9, 10, 11, 12, 13), rigidly mounted to the frame, are assigned to two printing mechanisms, respectively, so that a great number of idle wheels can be avoided.

Figure 2:
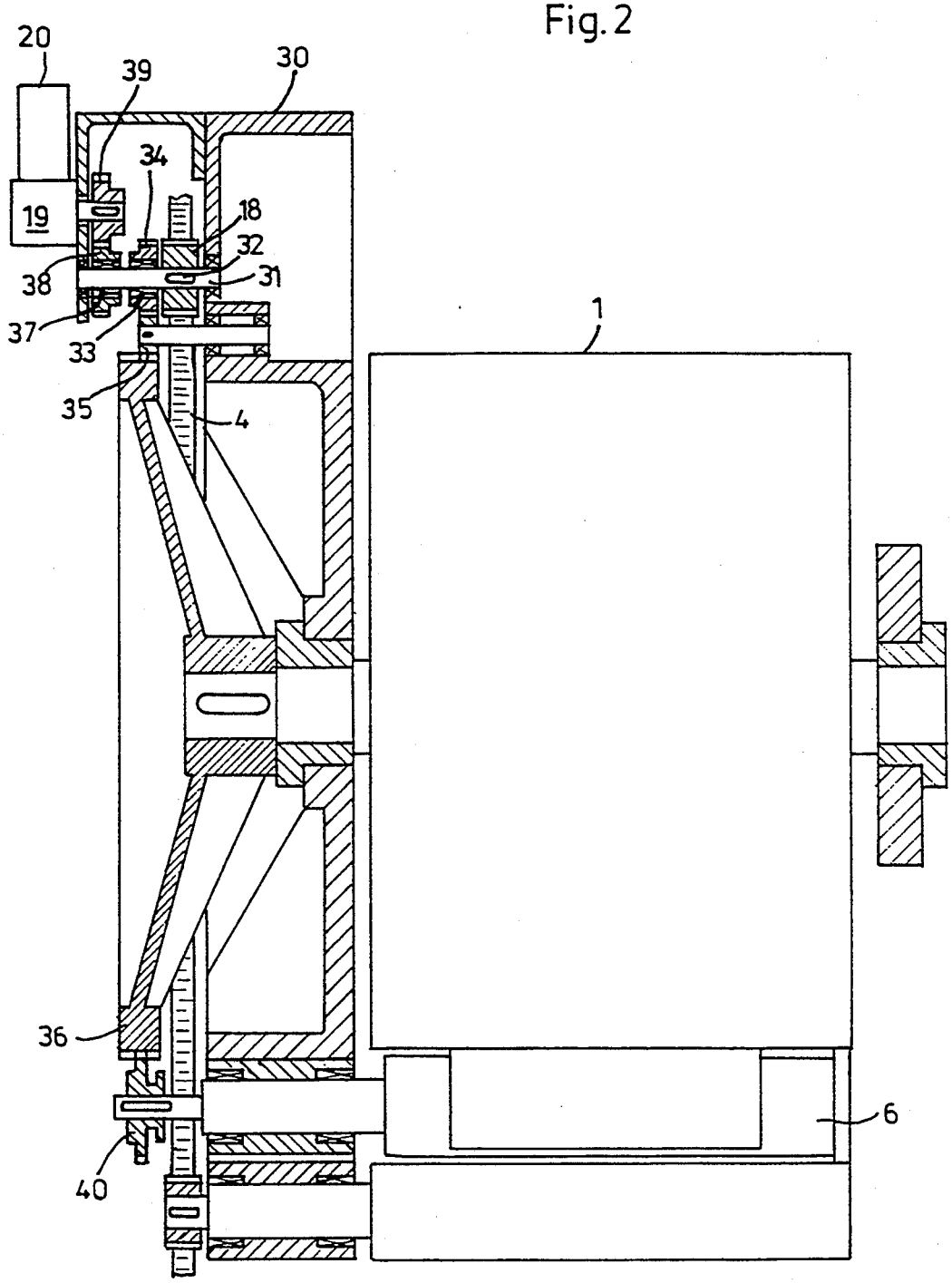

The driving of the toothed belt (4) is now explained in greater detail by means of FIG. 2. In the upper frame attachment (30) of the printing machine frame, a drive shaft (31) is provided, onto which the drive wheel (18) for the toothed belt (4) is rigidly placed by means of a feather key (32). Furthermore, on the drive shaft (31), via a freewheel (33), the toothed wheel (34) is placed, which meshes with the central wheel (36) connected with the impression roll (1) via an intermediate wheel (35). Finally, on the shaft (31), via an additional freewheel (37), a toothed wheel (38) is placed which meshes with the toothed drive wheel (39) of the geared servomotor (19, 20).

Hence, during normal printing operation, the toothed belt (4) is driven by the central wheel (36) via the toothed wheel (34) provided with the freewheel (33), which causes the shaft (31), provided with the drive wheel (18), to turn.

In the case of machine shutdowns, the servomotor (20) is turned on, so that the toothed belt (4) is driven at a lower speed via the pinion (39) and the toothed wheel (38), provided with the freewheel (37).

The size cylinders (6) are driven via the size cylinder toothed drive wheels (40), which directly mesh with the central wheel (36). For this reason, the size cylinders (6) can be exchanged, without the drive for the screen rolls having to be newly equipped.

While the invention has been described above with respect to certain embodiments thereof, it will be appreciated by one skilled in the art that variations and modifications may be made without departing from the spirit and scope of the invention.

What is claimed is:

1. A flexographic printing machine, comprising:

a printing machine frame (3) in which an impression roll (1) and a central drive gear (36) connected thereto are mounted, printing cylinder units, each unit including a printing cylinder (6) arranged around said impression roll, guides on the printing machine frame (3), each guide respectively receiving bearings of each said printing cylinder (6), an inking device slide for each printing cylinder movably mounted on each guide, and a screen roll (2) respectively mounted on each said inking device slide for mounting each said screen roll for movement substantially radially with respect to the impression roll (1), wherein each said printing cylinder and each said screen roll are driven by the central drive gear (36) and each said screen roll is motively connected via a freewheel (33) with the central drive gear (36), a continuous drive for each said screen roll (2) comprising a toothed belt (4), a servomotor (19, 20) for driving said toothed belt, said toothed belt (4) being engaged in a loop around a respective toothed drive wheel located on each said screen roll (2), said toothed belt passing across idle wheels (8–14, 7, 15), each printing cylinder unit having three said idle wheels immovably attached to said frame and one idle wheel (7) arranged on each said inking device slide, said toothed belt (4) having lengths (25, 26) which run onto and off respective ones of said idle wheels (7, 15), arranged radially outside and on both sides of each respective said screen roll toothed drive wheel (24), which extend in parallel with each other, and lengths (26, 27) of the toothed belt (4) enclosing respective ones of said idle wheels, arranged on one side of each respective said screen roll toothed drive wheel (24), which extend in parallel with each other, and means for moving each respective inking device slide on each said guide in a direction parallel with lengths (25, 26, 27) of the toothed belt (4) which extend parallel with each other.

2. A printing machine according to claim 1, wherein said servomotor (20) drives the toothed belt (4) via a freewheel (37) connected with said central drive gear.

3. A printing machine according to claim 1, wherein each screen roll (2) is driven by the central drive (36) via the toothed belt (4) by an intermediate toothed wheel (35) meshing with the central drive (36) and a toothed wheel (34), arranged on a drive shaft (31) for the toothed belt (4) meshing with the intermediate toothed wheel.

4. A printing machine according to claim 3, wherein the toothed wheel (34) meshing with the intermediate toothed wheel (35), is provided-with a freewheel (33).

5. A printing machine according to claim 1, wherein a drive shaft (31) for the toothed belt (4) is provided with a toothed wheel (38) and provided with an additional freewheel (37) which is actively connected to the servomotor (20).

6. A printing machine according to claim 1, wherein each printing cylinder (6) has a toothed wheel (40) which meshes directly with the central drive gear (36).

* * * * *